US008491051B2

(12) United States Patent
Zhang

(10) Patent No.: US 8,491,051 B2
(45) Date of Patent: Jul. 23, 2013

(54) INFANT CARRIER APPARATUS WITH CANOPY ACCESSORY

(75) Inventor: Da Liang Zhang, Kowloon (HK)

(73) Assignee: BP Children's Products HK Co., Ltd., Hong Kong (HK)

( * ) Notice: Subject to any disclaimer, the term of this patent is extended or adjusted under 35 U.S.C. 154(b) by 504 days.

(21) Appl. No.: 12/754,354

(22) Filed: Apr. 5, 2010

(65) Prior Publication Data

US 2010/0270832 A1 Oct. 28, 2010

Related U.S. Application Data

(60) Provisional application No. 61/169,727, filed on Apr. 16, 2009.

(51) Int. Cl.
*A47C 7/62* (2006.01)

(52) U.S. Cl.
USPC ..... 297/184.13; 472/118

(58) Field of Classification Search
USPC ..... 297/184.13; 472/118
See application file for complete search history.

(56) References Cited

U.S. PATENT DOCUMENTS

| | | | | |
|---|---|---|---|---|
| 1,430,389 | A | 9/1922 | Lindberg | |
| 2,483,953 | A | 10/1949 | Weiner et al. | |
| 5,522,639 | A | 6/1996 | Jaime | |
| 6,170,910 | B1 * | 1/2001 | Bapst | 297/184.13 X |
| 8,186,368 | B2 * | 5/2012 | Troutman et al. | 297/184.13 X |
| 2002/0036417 | A1 | 3/2002 | Kain et al. | |
| 2012/0034985 | A1 * | 2/2012 | Zhang | 472/118 |

FOREIGN PATENT DOCUMENTS

| | | | |
|---|---|---|---|
| EP | 0872400 | A3 | 8/1999 |
| EP | 2022375 | A1 | 2/2009 |
| GB | 2329116 | A | 3/1999 |
| GB | 2399770 | A | 9/2004 |

* cited by examiner

*Primary Examiner* — Anthony D Barfield
(74) *Attorney, Agent, or Firm* — David I. Roche; Baker & McKenzie LLP

(57) ABSTRACT

A canopy adjusting mechanism comprises a base including a coupling fixture and a holder plate, and a rotary part fixedly joined with the canopy and pivotally coupled with the holder plate for defining a rotation axis of the canopy. The coupling fixture is adapted to affix on a support frame, and the holder plate is adapted to detachably assemble with the coupling fixture. One of the holder plate and the rotary part comprises at least a first and second latching groove, and the other one of the holder plate and the rotary part has a detent operable to engage with either of the first and second latching groove for holding the canopy respectively at a first and second angular position.

20 Claims, 5 Drawing Sheets

INFANT CARRIER APPARATUS WITH CANOPY ACCESSORY

CROSS-REFERENCE TO RELATED APPLICATION(S)

This application claims priority of U.S. Provisional Patent Application No. 61/169,727 filed on Apr. 16, 2009.

BACKGROUND OF THE INVENTION

1. Field of the Invention

The present invention generally relates to an infant carrier apparatus, and more particularly to an infant carrier apparatus provided with a canopy accessory.

2. Description of the Related Art

An infant carrier apparatus (such as infant cradle, infant swing, child play yard and so on) can include a canopy accessory coupled on a support frame. In use, the canopy can cover at least partially an infant placed in the carrier apparatus for preventing unwanted exposure to an outside environment. Because the canopy isolates at least partially the child from the surrounding environment, the child can also be emotionally less distracted or affected by its environment.

Most canopy accessories currently available are only operable between a fully deployed and fully retracted state. Accordingly, the canopy cannot be adjusted to satisfactorily suit the use context. Therefore, there is a need for a structure design that can provide convenient and flexible adjustment of the canopy, and overcome at least the foregoing issues.

SUMMARY

The present application describes an infant carrier apparatus provided with a canopy accessory. In some embodiments, the infant carrier apparatus comprises a support frame, a canopy, and at least one canopy adjusting mechanism. The canopy adjusting mechanism includes a base affixed on the support frame, and a rotary part connected with the canopy and operable to rotate relative to the base about a rotation axis. One of the base and the rotary part comprises at least a first and second latching groove, and the other one of the base and the rotary part has a detent operable to engage with either of the first and second latching groove for holding the canopy respectively at a first and second angular position.

In another embodiment, a canopy adjusting mechanism is described. The canopy adjusting mechanism comprises a base including a coupling fixture and a holder plate, and a rotary part fixedly joined with a canopy and pivotally coupled with the holder plate for defining a rotation axis of the canopy. The coupling fixture is adapted to affix on a support frame, and the holder plate is adapted to detachably assemble with the coupling fixture. One of the holder plate and the rotary part comprises at least a first and second latching groove, and the other one of the holder plate and the rotary part has a detent operable to engage with either of the first and second latching groove for holding the canopy respectively at a first and second angular position relative to the support frame.

At least one advantage of the structures described herein includes the ability to adjust the canopy relative to the support frame of the infant carrier apparatus, and hold the canopy in a stable manner at the desired position. Moreover, if the use of the canopy is not desired, the canopy adjusting mechanism can be easily disassembled from the support frame. As a result, more flexible use of the canopy can be available to the user.

DETAILED DESCRIPTION OF THE EMBODIMENTS

The present application describes an infant carrier apparatus having a canopy accessory assembled between a left and right side of a support frame via a pair of canopy adjusting mechanisms. With the canopy adjusting mechanism, a user can quickly and conveniently operate and adjust the position of the canopy. Accordingly, the use of the canopy can be conveniently adjusted according to the user's requirement. Examples of the infant carrier device can include, without limitation, an infant car, an infant bed, an infant seat, an infant swing, an infant cradle and the like.

Figure 1:
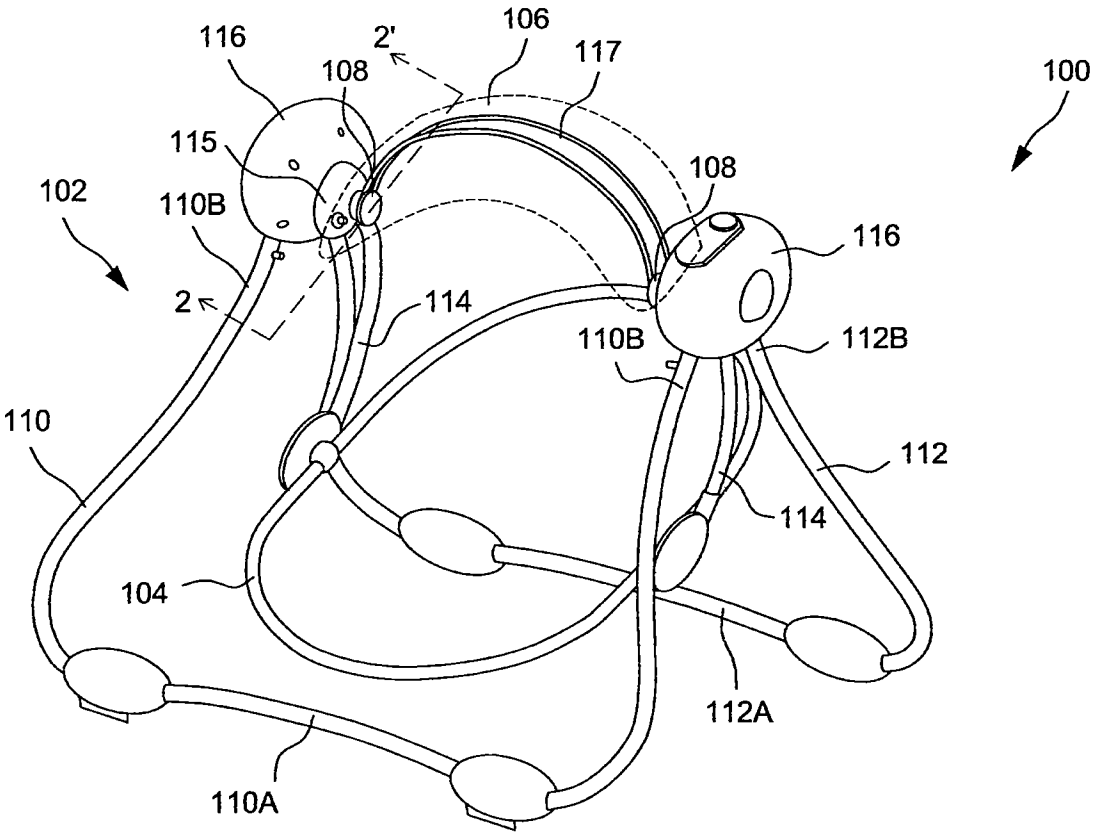
FIG. 1 is a schematic view illustrating an embodiment of an infant carrier apparatus provided with a canopy.

FIG. 1 is a schematic view illustrating an embodiment of an infant carrier device 100. In the illustrated embodiment, the infant carrier device 100 can be exemplary an infant swing. The infant carrier device 100 comprises a support frame 102, a carrier portion 104, a canopy 106, and a canopy adjusting mechanism 108 respectively provided on a left and right side of the canopy 106. The carrier portion 104 can include a seat hung from the support frame 102 and adapted to accommodate a child in a seating position. The canopy 106 can include a canopy frame 117 that is mounted between the left and right sides of the support frame 102. In one embodiment, the canopy frame 117 can be formed by a plurality of tubular sections assembled to define two elongated bars joined with each other and extending between the left and right side of the support frame 102. Either of the left and right ends of the canopy frame 117 can be respectively mounted with the canopy adjusting mechanisms 108 operable to adjust an angular position of the canopy 106.

As shown in FIG. 1, the support frame 102 can include a front leg 110, a rear leg 112, two swing arms 114, and two folding hinges 116. As shown, each of the front and rear leg 110 and 112 can be formed as a generally U-shaped tubular assembly including a bottom portion (e.g., bottom portion 110A for the front leg 110 and bottom portion 112A for the rear leg 112), and left and right side segments extending upward from the bottom portion to top portions (e.g., top portions 110B for the front leg 110 and top portions 112B for the rear leg 112). On each side of the support frame 102, the top portion 110B of the front leg 110 and the top portion 112B of the rear leg 112 are coupled with a folding hinge 116 respectively. By operating the folding hinge 116, the front and rear leg 110 and 112 can be folded upon each other to lie in substantially parallel positions for facilitating storage of the support frame 102. Each swing arm 114 has a top end portion pivotally connected with the support frame 102 via a pivot link 115 disposed adjacent to one corresponding folding hinge 116. The two pivot links 115 disposed on the two sides of the support frame 102 define a rotation axis around which the swing arms 114 can oscillate forth and back relative to the front and rear legs 110 and 112 of the support frame 102. The carrier portion 104 can be hung from a lower end of each of the swing arms 114, and include an accommodating space in which a child can be placed. Accordingly, oscillating motion of the swing arms 114 can be imparted to the carrier portion 104 for swinging a child placed in the carrier portion 104. For adjusting the canopy 106, each of the canopy adjusting mechanisms 108 is disposed adjacent to an inner side of each pivot link 115. Accordingly, oscillating motion of the swing arms 114 can also be imparted to the canopy adjusting mechanisms 108.

Figure 2:
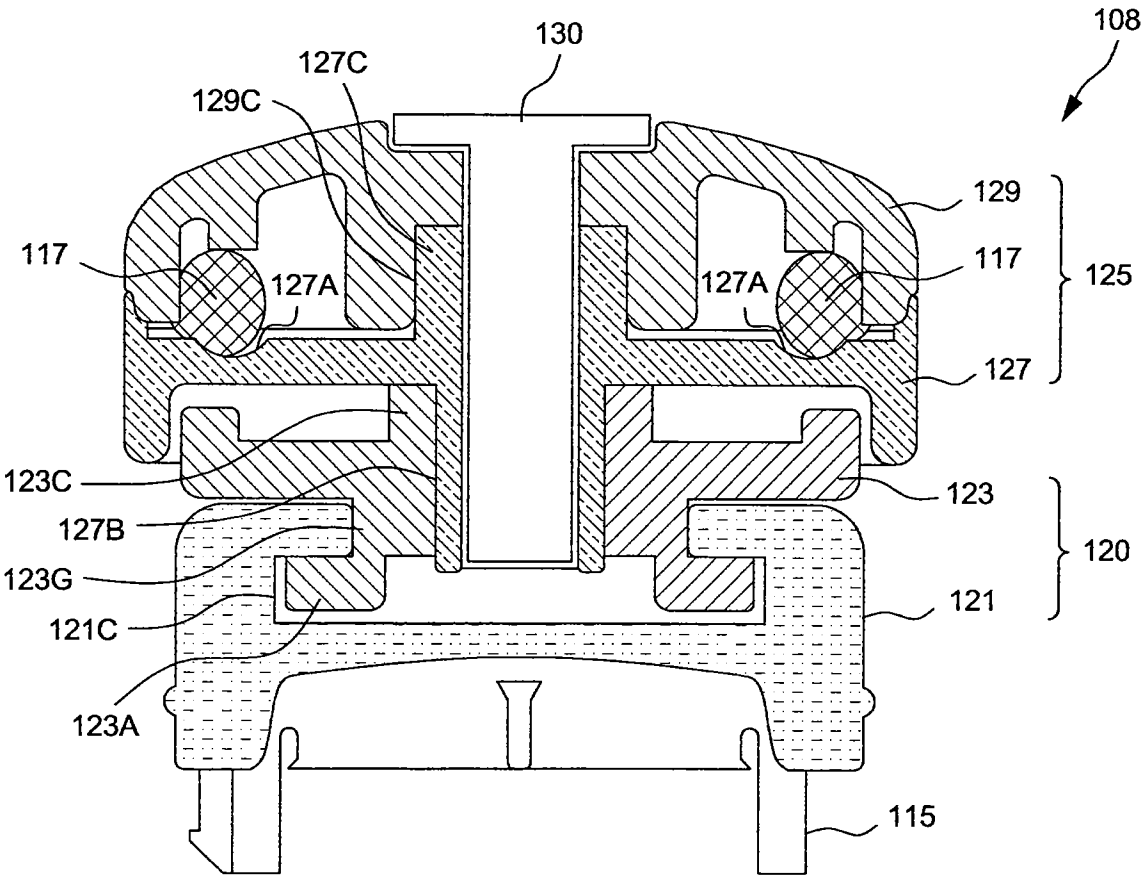
FIG. 2 is a cross-sectional view illustrating one embodiment of a canopy adjusting mechanism taken along section line 2-2' shown in FIG. 1.
Figure 3:
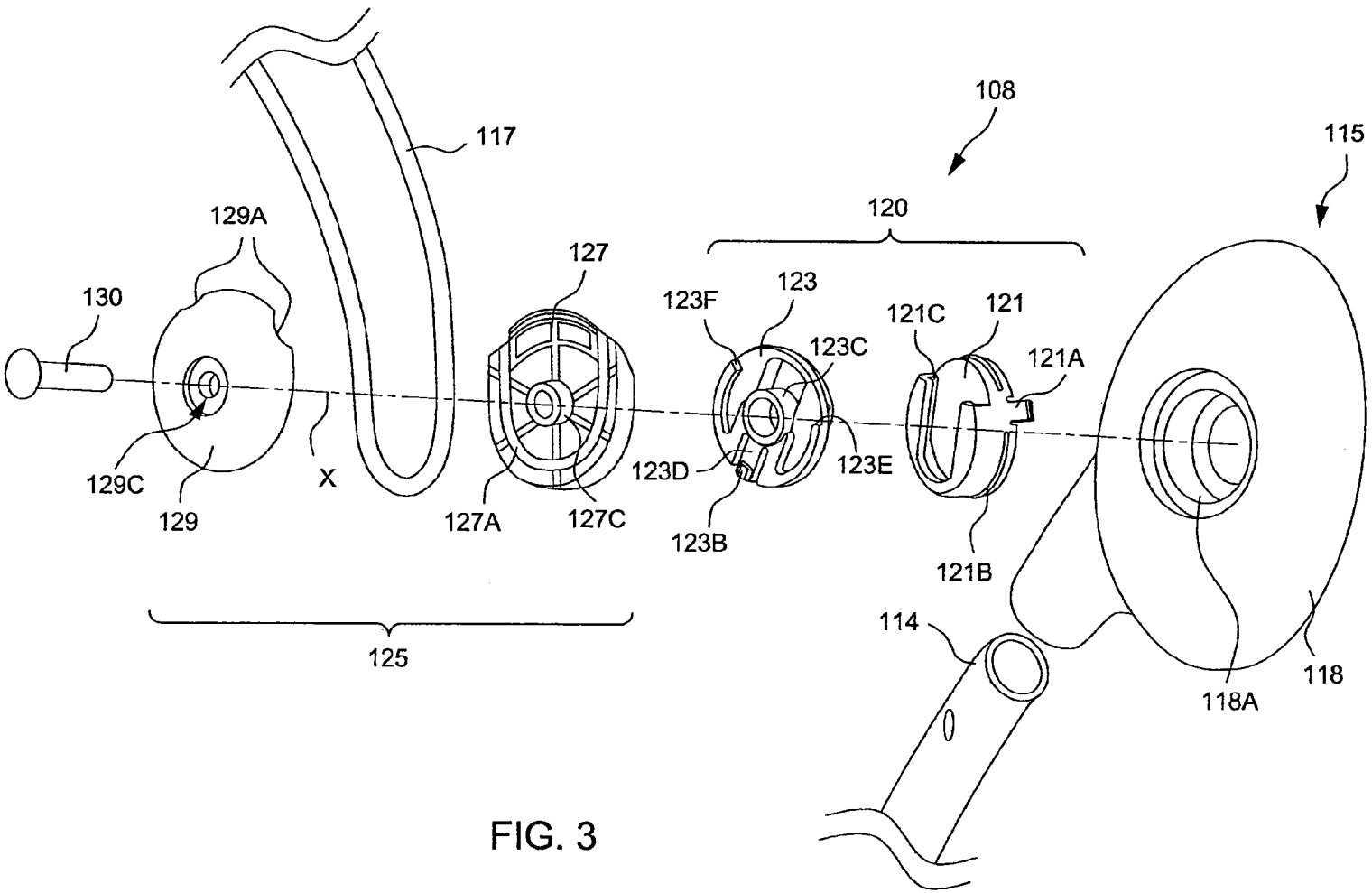
FIG. 3 is an exploded view of the canopy adjusting mechanism.

FIG. 2 is a cross-sectional view illustrating one embodiment of the canopy adjusting mechanism 108 taken along cross-section 2-2' of FIG. 1, and FIG. 3 is an exploded view of the canopy adjusting mechanism 108. As shown in FIGS. 2 and 3, the pivot link 115 can include a coupling shell 118 having an opening 118A. The coupling shell 118 is fixedly secured with the top end portion of the swing arm 114, and can rotate along with the swing arm 114 around a rotation axis X of the pivot link 115 for swinging the carrier portion 104. The canopy adjusting mechanism 108 can include a base 120, and a rotary part 125 operable to rotate relative to the base 120. The base 120 is fixedly assembled on the coupling shell 118. The rotary part 125 is fixedly secured with an end portion of the canopy frame 117, and pivotally couple with the base 120 for permitting angular adjustment of the canopy 106 relative to the support frame 102.

Figure 4:
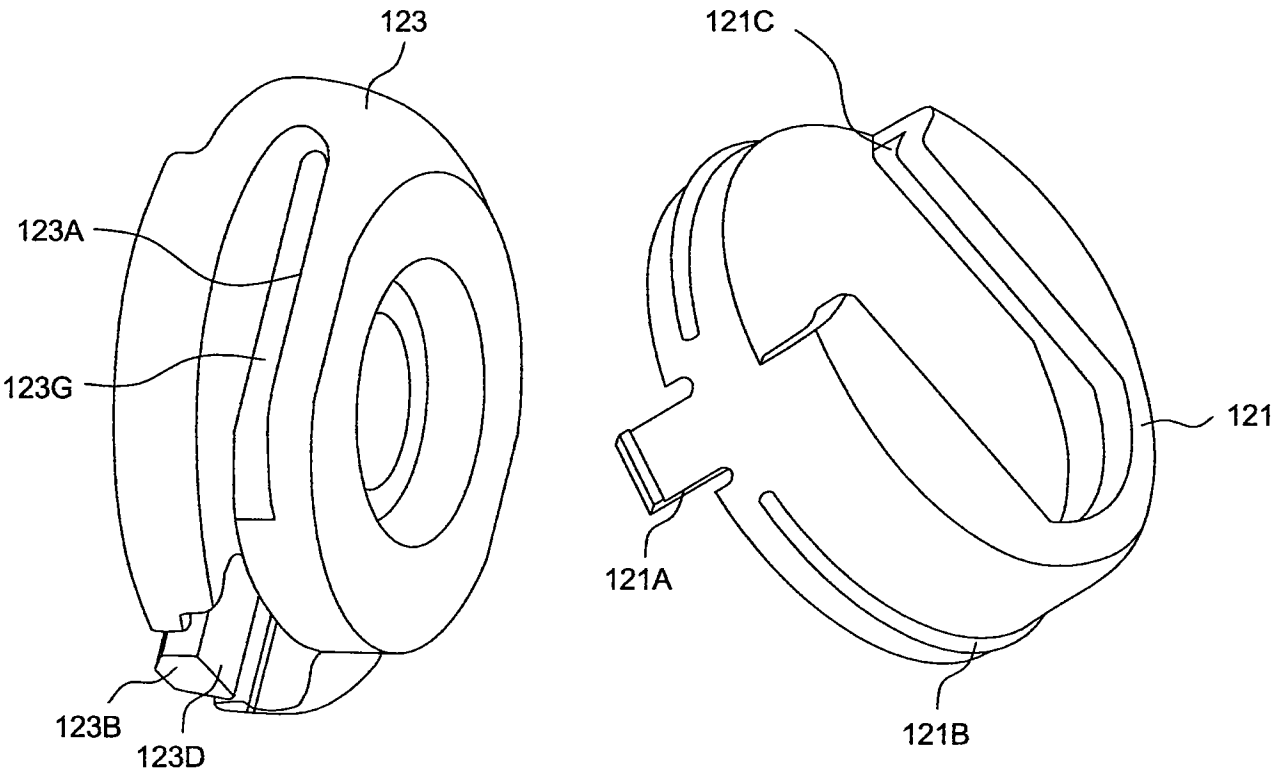
FIG. 4 is a schematic view illustrating the construction of a base used in the canopy adjusting mechanism.

In conjunction with FIGS. 2 and 3, FIG. 4 is a schematic view illustrating the construction of the base 120. As shown, the base 120 can be formed by the assembly of a coupling fixture 121 and a holder plate 123. The coupling fixture 121 is fixedly secured with the coupling shell 118 on the support frame 102 at one side, and can assemble with the holder plate 123 in a detachable manner at the other side. More specifically, the coupling fixture 121 can have a generally circular shape provided with a resilient catch 121A and a shoulder portion 121B formed along a circumference of the coupling fixture 121. The coupling fixture 121 can be disposed through the opening 118A of the coupling shell 118 such that the shoulder portion 121B lies in abutment against an edge of the opening 118A. The resilient catch 121A can then snap fit with a corresponding anchor structure in the coupling shell 118 for fixedly locking the coupling fixture 121 with the coupling shell 118. A side of the coupling fixture 121 opposite the shell 118 has a pocket 121C that is open at one end. The holder plate 123 can include a raised portion 123G provided with lateral flanges 123A adapted to engage through the pocket 121C of the coupling fixture 121. For mounting the holder plate 123 with the coupling fixture 121, the raised portion 123G of the holder plate 123 can be fitted through the pocket 121C such that the lateral flanges 123A can be retained by rim portions of the pocket 121C. In this manner, the holder plate 123 can be secured with the coupling fixture 121 in a detachable manner.

It is worth noting that while the foregoing embodiment describes a particular structure for assembling the coupling fixture 121 and holder plate 123, alternate embodiments can also adopt other structures for connecting the coupling fixture 121 and holder plate 123. For example, some variant embodiments can interchangeably dispose the pocket on the holder plate and the raised portion and flanges on the coupling fixture. The holder plate and coupling fixture can be detachably coupled with each other by engaging the raised portion and flanges through the pocket, similar to the previous embodiment.

In conjunction with FIGS. 2 through 4, FIG. 5 is a schematic view illustrating how the rotary part 125 is coupled with the base 120. As shown, a side of the holder plate 123 facing the rotary part 125 comprises a shaft sleeve 123C, and a detent 123D formed by a resilient tab extending along one radial direction relative to the shaft sleeve 123C. A distal end of the detent 123D can also have a protruding stud 123B. Once the rotary part 125 is assembled with the base 120, the detent 123D is adapted to engage with the rotary part 125 for restrainedly fixing the position of the rotary part 125 relative to the base 120.

It is worth noting that while the illustrated embodiment uses a detachable structure for forming the base 120, alternate embodiments can also form the base in a single piece by integrating the holder plate and coupling fixture into a single integral part.

As better shown in FIGS. 2 and 3, the rotary part 125 can be formed by the assembly of a coupling plate 127 and a shell 129. A side surface of the coupling plate 127 opposite the base 120 can include a recess 127A and a hollow sleeve 127C. An inner surface of the shell 129 can be provided with notches 129A corresponding to the recess 127A, and an opening 129C adapted to accommodate the sleeve 127C. The recess 127A is adapted to receive the placement of an end portion of the canopy frame 117. Once the end portion of the canopy frame 117 is mounted in the recess 127A of the coupling plate 127, the shell 129 can be assembled with the coupling plate 127 such that the sleeve 127C is fitted through the opening 129C of the shell 129 and the end portion of the canopy frame 117 is clamped between the coupling plate 127 and the shell 129. The shell 129 and coupling plate 127 can be then securely locked with each other via a fastener element 130 (e.g., a rivet or screw) engaging through the shell 129, the sleeve 127C and the spindle 127B of the coupling plate 127. Once assembled, the canopy frame 117 extends out of the rotary part 125 through the notches 129A of the shell 129.

Figure 5:
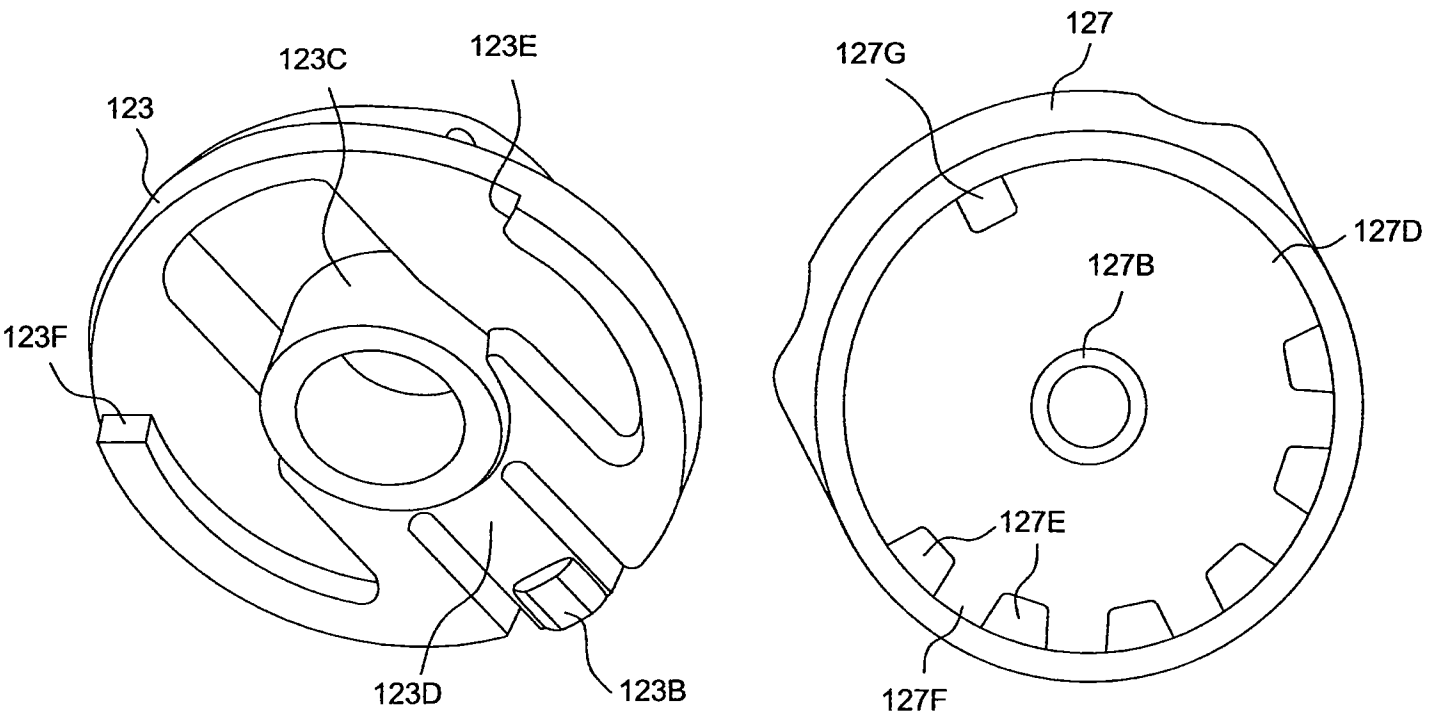
FIG. 5 is a schematic view illustrating how a rotary part is coupled with the base for forming the canopy adjusting mechanism.

As better shown in FIG. 5, a side surface 127D of the coupling plate 127 facing the holder plate 123 and opposite the side surface of the recess 127A includes a hollow spindle 127B protruding from a central region, and a plurality of abutment protrusions 127E disposed along a periphery at multiple radial positions relative to the spindle 127B. The spindle 127B and sleeve 127C can be coaxial. The abutment protrusions 127E are angularly spaced apart from one another so as to define a plurality of latching grooves 127E, each latching groove 127E being delimited between two adjacent abutment protrusions 127E.

When the rotary part 125 is assembled with the base 120, the spindle 127B is pivotally assembled through the shaft sleeve 123C for allowing rotation of the rotary part 125 relative to the base 120. For reinforcing the rotation axle defined by the spindle 127B, the fastener element 130 can extend through the spindle 127B into the shaft sleeve 123C of the holder plate 123. In addition, the stud 123B of the detent 123D and the abutment protrusions 127E lie in a gap defined between the side surface 127D of the coupling plate 127 and the holder plate 123. The stud 123B of the detent 123D is thereby adapted to engage with any of the latching grooves 127F for restrainedly holding an angular position of the rotary part 125 and the canopy 106 affixed thereto relative to the support frame 102.

In one embodiment, the rotation axis of the rotary part 125 relative to the base 120 can be aligned with the rotation axis X of the pivot link 115 around which the carrier portion 104 is swung. As a result, the weight load sustained by the rotation axis can be more uniformly distributed, and rotation movement around the rotation axis X can be facilitated.

If a user wants to change the angular position of the canopy 106, the canopy 106 and rotary part 125 can be driven to rotate relative to the base 120 being fixedly mounted on the support frame 102 (better shown in FIG. 1). While the rotary part 125 rotates during adjustment, the detent 123D can resiliently deflect toward and away from the side surface 127D of the coupling plate 127 as the stud 123B successively passes through a latching groove 127F and presses against an abutment protrusion 127F. Once the canopy 106 reaches a desired angular position, the stud 123B of the detent 123D can engage with another latching groove 127F for restrainedly holding the canopy 106 in a stable manner. Owing to the resilient deflection of the detent 123D and a smoothly curved surface of the abutment protrusions 127E, the user does not need to apply a significant force for the stud 123B to leave a latching groove 127F and disengage a latched position of the canopy 106. With this construction, adjustment of the canopy 106 can thus be facilitated. The number of latching grooves 127F can determine the range of adjustable angular positions of the canopy 106.

For preventing excessive rotation of the canopy 106, a movement restraining structure can be provided in the canopy adjusting mechanism 108. In one embodiment, the movement restraining structure can include two stop flanges 123E and 123F provided on the holder plate 123, and a knob 127G provided on the side surface 127D of the coupling plate 127. The stop flanges 123E and 123F are spaced apart from each at two different radial directions relative to the rotation axis of the rotary part 125, and protrude from the holder plate 123 toward the side surface 127D of the coupling plate 127. The knob 127G protrudes from the side surface 127D at a position spaced apart from the region of the abutment protrusions 127E. When the rotary part 125 rotates in a first direction, the knob 127G can come into abutment against one of the two stop flanges (e.g., the stop flange 123F) for delimiting the maximum amount of rotation of the rotary part 125 in the first direction. When the rotary part 125 rotates in a second direction, the knob 127G can come into abutment against the other one of the two stop flanges (e.g., the stop flange 123E) for delimiting the maximum amount of rotation of the rotary part 125 in the second direction. In this manner, angular displacement of the rotary part 125 and canopy 106 relative to the support frame 102 can be limited within the predetermined range of adjustable angular positions (i.e., corresponding to the region of the abutment protrusions 127F).

While the illustrated embodiment forms the detent 123D on the base 120 and the latching grooves 127F on the rotary part 125, it will be appreciated that the position of the detent and latching grooves can be interchanged with respect to the base 120 and the rotary part 125 (e.g., the detent can be provided on the rotary part, whereas and the latching grooves are provided on the base) without affecting the operation of the canopy adjusting mechanism.

When the use of the canopy 106 is not needed, the canopy 106 and its adjusting mechanism 108 can be easily disassembled from the support frame 102 by, for example, dismounting the rotary part 125 and holder plate 123 from the coupling fixture 121. Accordingly, separate disposal and storage of the canopy 106 can be facilitated.

At least one advantage of the structures described herein includes the ability to adjust the canopy relative to the support frame of the infant carrier apparatus, and hold the canopy in a stable manner at the desired position. In addition, if the use of the canopy is not desired, the canopy adjusting mechanism can be easily disassembled from the support frame. As a result, more flexible use of the canopy can be available to the user.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. An infant carrier apparatus comprising:

a support frame;

a canopy; and at least one canopy adjusting mechanism including:

a base affixed on the support frame; and a rotary part fixedly joined with the canopy and pivotally coupled with the base for defining a rotation axis of the canopy, wherein one of the base and the rotary part comprises at least a first and second latching groove, and the other one of the base and the rotary part has a detent operable to engage with either of the first and second latching groove for holding the canopy respectively at a first and second angular position, the detent including a resilient tab having a distal end provided with a protruding stud; and wherein an abutment protrusion is provided between the first and the second latching grooves, and the stud comes in contact with the abutment protrusion for causing the detent to deflect away from the rotary part when the rotary part rotates relative to the base.

2. The infant carrier apparatus according to claim 1, wherein the resilient tab extends radial relative to the rotation axis.

3. The infant carrier apparatus according to claim 1, wherein the base includes two stop flanges, and the rotary part includes a stop knob that is movable along with the rotary part to come in abutment against either of the two stop flanges for limiting a rotation range of the rotary part relative to the base.

4. The infant carrier apparatus according to claim 1, wherein the canopy includes a canopy frame having at least one side end portion fixedly secured with the rotary part.

5. The infant carrier apparatus according to claim 4, wherein the rotary part includes a coupling plate and a shell coupled with each other to fixedly secure the side end portion of the canopy frame there between.

6. An infant carrier apparatus comprising:

a support frame, wherein the support frame includes a plurality of support legs, at least a swing arm and a carrier portion, a first end portion of the swing arm being coupled with the carrier portion, and a second end portion of the swing arm being coupled with a pivot link, whereby the swing arm is adapted to impart oscillating motion to the carrier portion relative to the support legs;

a canopy; and at least one canopy adjusting mechanism including:

a base affixed on the support frame; and a rotary part fixedly joined with the canopy and pivotally coupled with the base for defining a rotation axis of the canopy, wherein one of the base and the rotary part comprises at least a first and second latching groove, and the other one of the base and the rotary part has a detent operable to engage with either of the first and second latching groove for holding the canopy respectively at a first and second angular position.

7. The infant carrier apparatus according to claim 6, wherein the support legs are connected with a folding hinge, and the pivot link is mounted adjacent to the folding hinge.

8. The infant carrier apparatus according to claim 6, wherein the pivot link includes a coupling shell joined and movable along with the swing arm.

9. The infant carrier apparatus according to claim 8, wherein the base is affixed on the coupling shell.

10. The infant carrier apparatus according to claim 9, wherein the rotation axis of the canopy is aligned with a rotation axis of the swing arm defined by the pivot link.

11. The infant carrier apparatus according to claim 6, wherein the detent includes a resilient tab having a distal end provided with a protruding stud, an abutment protrusion is provided between the first and the second latching grooves, and the stud comes in contact with the abutment protrusion for causing the detent to deflect away from the rotary part when the rotary part rotates relative to the base.

12. The infant carrier apparatus according to claim 11, wherein the resilient tab extends radial relative to the rotation axis.

13. The infant carrier apparatus according to claim 6, wherein the base includes a coupling fixture and a holder plate, the coupling fixture connects with the support frame, the holder plate is pivotally coupled with the rotary part, and the coupling fixture and the holder plate are detachably secured with each other.

14. The infant carrier apparatus according to claim 13, wherein one of the coupling fixture and the holder plate includes a raised portion and lateral flanges, and the other one of the coupling fixture and the holder plate includes a pocket through which the raised portion and lateral flanges are engaged for detachably securing the coupling fixture with the holder plate.

15. The infant carrier apparatus according to claim 13, wherein the coupling fixture includes a resilient catch operable to engage with the support frame.

16. The infant carrier apparatus according to claim 6, wherein the canopy includes a canopy frame having at least one side end portion fixedly secured with the rotary part.

17. The infant carrier apparatus according to claim 16, wherein the rotary part includes a coupling plate and a shell coupled with each other to fixedly secure the side end portion of the canopy frame there between.

18. An infant carrier apparatus comprising:

a support frame;

a canopy; and at least one canopy adjusting mechanism including:

a base affixed on the support frame, wherein the base includes a coupling fixture and a holder plate, the coupling fixture connects with the support frame and includes a resilient catch operable to engage with the support frame, the holder plate is pivotally coupled with the rotary part, and the coupling fixture and the holder plate are detachably secured with each other; and a rotary part fixedly joined with the canopy and pivotally coupled with the holder plate of the base for defining a rotation axis of the canopy, wherein one of the base and the rotary part comprises at least a first and second latching groove, and the other one of the base and the rotary part has a detent operable to engage with either of the first and second latching groove for holding the canopy respectively at a first and second angular position.

19. The infant carrier apparatus according to claim 18, wherein one of the coupling fixture and the holder plate includes a raised portion and lateral flanges, and the other one of the coupling fixture and the holder plate includes a pocket through which the raised portion and lateral flanges are engaged for detachably securing the coupling fixture with the holder plate.

20. The infant carrier apparatus according to claim 18, wherein the canopy adjusting mechanism further includes a fastener element passing through the rotary part and the holder plate.

* * * * *